US009316105B2

(12) United States Patent
Khanin et al.

(10) Patent No.: US 9,316,105 B2
(45) Date of Patent: Apr. 19, 2016

(54) TURBINE BLADE

(75) Inventors: Alexander Anatolievich Khanin, Moscow (RU); Andrei Vladimirovich Pipopulo, Moscow (RU)

(73) Assignee: ALSTOM TECHNOLOGY LTD, Baden (CH)

( * ) Notice: Subject to any disclaimer, the term of this patent is extended or adjusted under 35 U.S.C. 154(b) by 913 days.

(21) Appl. No.: 13/535,428

(22) Filed: Jun. 28, 2012

(65) Prior Publication Data

US 2013/0011264 A1 Jan. 10, 2013

(30) Foreign Application Priority Data

Jul. 1, 2011 (RU) ..... 2011127156

(51) Int. Cl.
*F01D 5/26* (2006.01)
*F01D 5/14* (2006.01)
*F01D 5/30* (2006.01)

(52) U.S. Cl.
CPC ..... *F01D 5/3007* (2013.01); *F01D 5/26* (2013.01); *F05D 2260/96* (2013.01)

(58) Field of Classification Search
CPC ..... F01D 5/26; F01D 5/3007; F01D 5/3015; F01D 11/006; F01D 11/008; F05D 2260/96
USPC ..... 416/239, 219 R, 193 A
See application file for complete search history.

(56) References Cited

U.S. PATENT DOCUMENTS 2,141,401 A 12/1938 Martinka
2,162,588 A * 6/1939 Prince ..... H01H 33/92 218/91
2,915,279 A 12/1959 Chamberlin et al.
4,595,340 A 6/1986 Klassen et al.

(Continued)

FOREIGN PATENT DOCUMENTS

CN 1798634 A 7/2006
CN 102031998 A 4/2011

(Continued)

OTHER PUBLICATIONS

Office Action issued on Jul. 17, 2014, by the Chinese Patent Office in corresponding Chinese Patent Application No. 201210224258.0, and an English Translation of the Office Action. (25 pages).

(Continued)

*Primary Examiner* — Igor Kershteyn
*Assistant Examiner* — Jesse Prager
(74) *Attorney, Agent, or Firm* — Buchanan Ingersoll & Rooney PC

(57) ABSTRACT

A blade for a rotor of a turbine includes an airfoil, a shroud and a platform. The platform includes a top plate, a shank and a fixing part. An upstream wall projects in the circumferential direction away from the shank and extends from the top plate toward the fixing part, the upstream wall at least partially covering an upstream side of the shank. A downstream wall projects in the circumferential direction away from the shank and extends from the top plate toward the fixing part, the downstream wall at least partially covering a downstream side of the shank. A recess is disposed in at least one of the upstream wall and the downstream wall. The recess has an open side facing in a same direction as a respective one of the upstream wall and the downstream wall, in which the recess is disposed, is projecting.

14 Claims, 2 Drawing Sheets

(56) References Cited

U.S. PATENT DOCUMENTS

| | | | | |
|---|---|---|---|---|
| 5,435,694 | A | 7/1995 | Kray et al. | |
| 5,947,687 | A | 9/1999 | Mori et al. | |
| 6,086,329 | A | 7/2000 | Tomita et al. | |
| 6,354,803 | B1 | 3/2002 | Grover et al. | |
| 6,390,775 | B1 | 5/2002 | Paz | |
| 7,037,078 | B2 | 5/2006 | Soupizon et al. | |
| 8,007,245 | B2 | 8/2011 | Brittingham et al. | |
| 2004/0247442 | A1 | 12/2004 | Nishimura et al. | |
| 2006/0257262 | A1 | 11/2006 | Itzel et al. | |
| 2007/0269313 | A1 | 11/2007 | Nadvit | |
| 2007/0292271 | A1 | 12/2007 | Bil et al. | |
| 2009/0142195 | A1 | 6/2009 | Brittingham et al. | |
| 2010/0158696 | A1* | 6/2010 | Pandey et al. | 416/243 |
| 2010/0329888 | A1 | 12/2010 | Nadvit et al. | |
| 2011/0081245 | A1 | 4/2011 | Walunj et al. | |

FOREIGN PATENT DOCUMENTS

| | | | |
|---|---|---|---|
| DE | 2816791 | A1 | 11/1978 |
| EP | 1507066 | A2 | 2/2005 |
| EP | 1528224 | A2 | 5/2005 |
| GB | 508436 | A | 6/1939 |
| JP | S61-55302 | A | 3/1986 |
| JP | 2000220405 | A | 8/2000 |
| JP | 2004-245222 | A | 9/2004 |
| JP | 2009-133316 | A | 6/2009 |
| RU | 2154168 | C1 | 8/2000 |
| SU | 1127979 | A1 | 12/1984 |

OTHER PUBLICATIONS

Russian Office Action dated May 20, 2014, issued in corresponding Russian Patent Application No. 2011127156 and an English translation thereof. (12 pgs).

Search Report (Form PCT/ISA 201a) dated Jan. 20, 2012, issued in corresponding Swiss Patent Application No. 14192011.

Office Action (Notification of Reasons for Refusal) issued on Jan. 5, 2015, by the Japanese Patent Office in corresponding Japanese Patent Application No. 2012-148425 and an English translation of the Office Action. (14 pages).

European Patent Office, Extended European Search Report in European Patent Application No. 12174486.6 (May 31, 2013).

Office Action (Decision on Grant) issued on Feb. 11, 2015, by the Russian Patent Office in corresponding Russian Patent Application No. 2011127156/06 and an English translation of the Office Action. (13 pages).

Office Action (Decision of Grant) issued on Oct. 19, 2015, by the Japanese Patent Office in corresponding Japanese Patent Application No. 2012-148425 (2 pages).

* cited by examiner

TURBINE BLADE

CROSS-REFERENCE TO PRIOR APPLICATION

Priority is claimed to Russian Patent Application No. RU 2011127156, filed on Jul. 1, 2011, the entire disclosure of which is hereby incorporated by reference herein

FIELD

The present invention relates to a blade for a rotor of a turbine, in particular of a gas turbine. The invention relates furthermore to a rotor as well as to a turbine comprising at least one such blade.

PRIOR ART

A turbine converts the expansion energy of a fluid into a rotation of a rotor, this rotational energy can be further utilised. The rotor comprises blades being connected to a shaft of the rotor in a radial manner. Said connection is usually realised by means of a fixing part of the blade, with the fixing part being arranged below a shank of a platform of the blade, wherein the term, 'below', is defined with respect to the radial direction of the shaft. The driving fluid, in particular an expanding gas, thereby moves the blades leading to a rotation of the shaft. A blade comprises an airfoil, which is connected to a top plate of the platform at the inner end of the airfoil, wherein the top plate is arranged above the shank and the inner end is defined with respect to the radial direction in relation to the shaft. Furthermore in order to reduce a leakage of the driving fluid and thus the expanding gas, the blade comprises a shroud at the outer end of the airfoil. Said shroud can further comprise a fin, wherein the fin cooperates with a facing counterpart of the turbine to reduce said leakage.

SUMMARY

In an embodiment, the present invention provides a blade for a rotor of a turbine including an airfoil, a shroud disposed at an outer end of the airfoil and a platform disposed at an inner end of the airfoil. The platform includes a top plate disposed adjacent to the airfoil, a shank disposed below the top plate and a fixing part disposed below the shank, the shank and the fixing part each extending in a radial direction of the blade. The shank includes a front side and a back side opposite the front side and facing in a circumferential direction of the blade, as well as a downstream side and an upstream side opposite the downstream side and facing in an axial direction of the blade. An upstream wall projects in the circumferential direction away from the shank and extends from the top plate toward the fixing part, the upstream wall at least partially covering the upstream side of the shank. A downstream wall projects in the circumferential direction away from the shank and extends from the top plate toward the fixing part, the downstream wall at least partially covering the downstream side of the shank. At least one recess is disposed in a region of the shank in at least one of the upstream wall and the downstream wall and at least partially penetrates the at least one of the upstream wall and the downstream wall in the axial direction. The at least one recess has an open side facing in a same direction as a respective one of the at least one of the upstream wall and the downstream wall, in which the at least one recess is disposed, is projecting.

BRIEF DESCRIPTION OF THE DRAWINGS

The present invention will be described in even greater detail below based on the exemplary figures, which are schematic. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
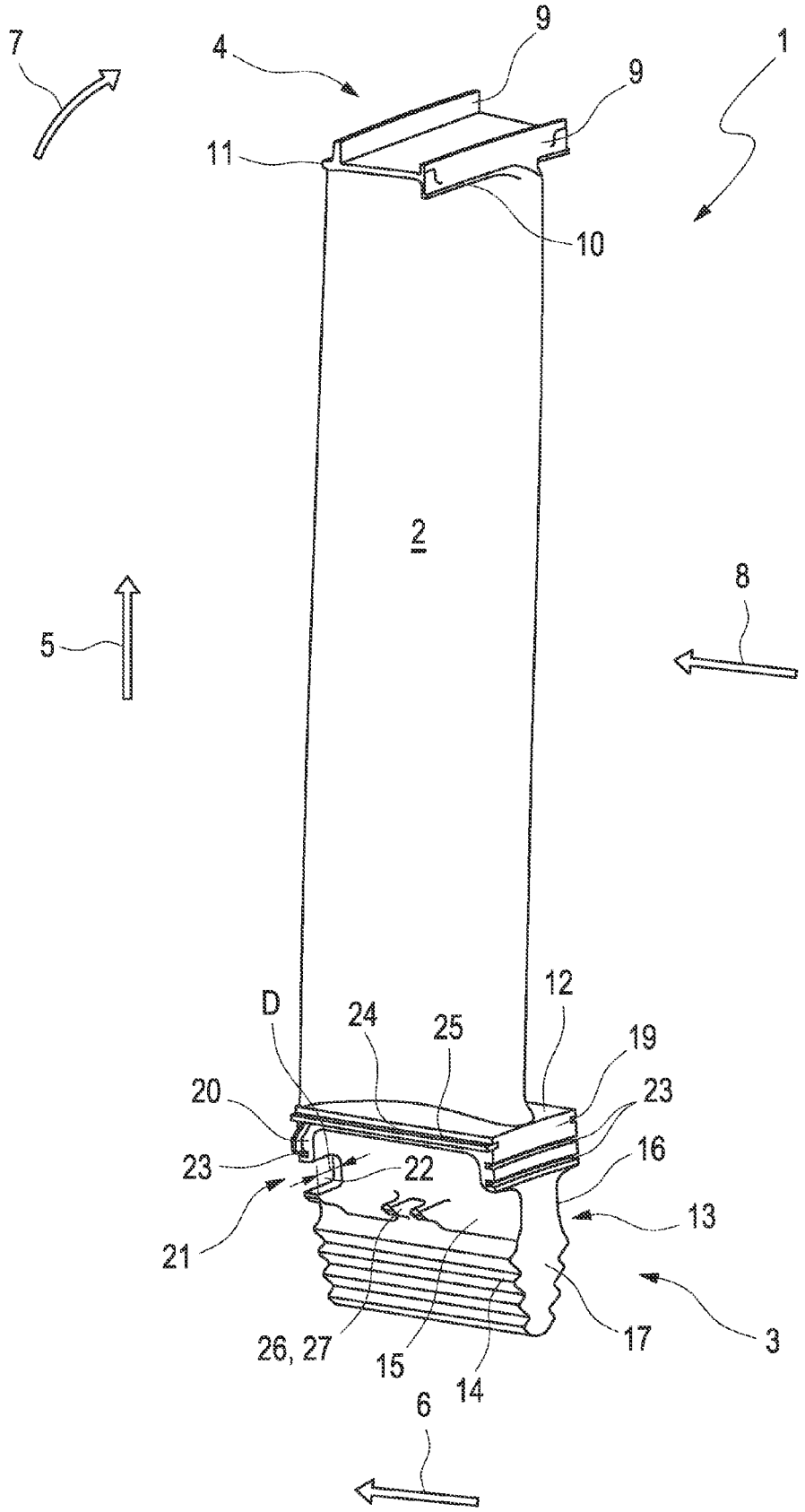
FIG. 1 shows a perspective view of a blade.

The present invention recognizes the problem that the blade, in particular the airfoil, has resonant frequencies which overlap with certain rotation frequencies of the corresponding rotor leading to undesired and destructive vibrations, in particular if the blade comprises a shroud arranged at the outer side of the airfoil.

The present invention addresses this problem by providing, in an embodiment, an improved or at least alternative embodiment for a blade of the named kind having improved mechanical properties.

The invention, in an embodiment, provides an upstream wall and/or a downstream wall of a platform of a blade with at least one recess provided in and, in particular, penetrating axially through at least one of the said walls, wherein said walls run radially from a top plate of the platform, the top plate supporting an airfoil of the blade at the inner end of the airfoil, towards a fixing part of the platform arranged below a shank of the platform thereby at least partially covering or extending along an upstream side of the shank or a downstream side of the shank and projecting along the circumferential direction and away from the shank. An axial penetration through the walls thereby does not necessarily require a substantial axial run of the recess. It merely means that the recess runs from the side of the wall axially opposing the shank to the side of the wall axially facing the shank. Furthermore, the wall can be penetrated by the recess partially or entirely. The recess moreover has an open side facing in the same direction as the direction of projection of the respective wall in which the recess is provided. The blade comprises furthermore a shroud arranged at the outer end of the airfoil, wherein the shroud usually serves to reduce a leakage of a driving fluid of a turbine comprising a rotor with said blade. The rotor further comprises a rotating shaft defining an axial direction along the shaft as well as a radial direction and a circumferential direction. The directions and positions given here thereby refer to said directions. The terms "below" and "top", for instance, are given with respect to the radial direction. Thus the arrangement of the fixing part below the shank means that the fixing part is closer to the shaft than the shank along the radial direction and the top plate of the platform is further away form the shaft, when the blade is connected to said shaft. Similarly, the inner end of the airfoil is the end closer to the shaft than the outer end. The terms "downstream" and "upstream" are in relation to a flow direction of the driving fluid of the turbine, wherein the flow direction generally runs parallel to the axial direction of the shaft. The upstream side is therefore the side facing the flow direction and the downstream side is the opposing side, respectively. The same definitions apply for the upstream wall and the downstream wall. The shank of the platform further comprises a front side and a back side along the circumferential direction. The downstream wall thereby projects away from the front side and/or the back side of the shank. That is, the downstream wall can run along the front side and the downstream side of the shank, or the downstream wall can run along the front side and the back side of the shank on the downstream side. The downstream side can thereby have different or similar dimensions along the front side and the back side, i.e. for instance, while the downstream wall runs along the entire front side of the shank on the downstream side it can run over a part of the back side of the shank on the downstream side. Similarly to the downstream wall, the upstream wall projects away from the front side and/or the back side of the shank but is arranged on the upstream side of the shank.

As mentioned above, the blade, in particular the airfoil, comprises resonant frequencies which overlap with certain rotation frequencies of the corresponding rotor leading to undesired and destructive vibrations. The invention, in an embodiment, provides the blade with at least one recess of the said kind that in particular avoids unwanted resonant frequencies of the blade and thus prevents or at least reduces resonance effects or vibrations which results in improved mechanical properties of the blade and in particular in a longer durability.

According to the invention the downstream wall comprises a recess in a preferred embodiment. The recess thereby penetrates through the downstream wall and is preferably arranged on the front side of the shank. It can however also be arranged on the back side of the shank, wherein the opening of the recess projects away from the front side or the back side of the shank, respectively, and thus along the same direction as the downstream wall.

According to a further embodiment the upstream wall comprises a recess. Similarly to the recess of the downstream wall, this recess is preferably arranged on the front side of the shank and its opening is therefore projected away from the front side. It can however also be projected on the back side of the shank, wherein its opening projects away from the back side in the latter case.

According to another embodiment the blade comprises several recesses. These recesses can thereby be arranged within the upstream wall and/or the downstream wall. They can further be arranged on the front side and/or the back side of the shank with a corresponding projection of the respective openings. The single recesses can further have different sizes and shapes or similar sizes and shapes. The recesses can also be shaped identically and/or have the same size.

As mentioned above, a recess can have an arbitrary shape and size, wherein the shape and size of the recess is in particular restricted by the shape and size of the corresponding downstream wall and upstream wall, respectively. The upstream wall and the downstream wall are also of arbitrary shape and size, which leads to a large number of possibilities for recesses, when constructing a blade. The downstream wall and the upstream wall thereby have different sizes and shapes in general. However, a preferred shape of the recess is a cylindrical-like shape, which in particular allows a simple construction and/or assembly.

According to a preferred embodiment the front side of the shank comprises a curved shape. Thus the front side is in particular concave shaped. That is, in particular, if the blade is assembled with in a rotor, the front side comprises a concave shape when viewed from the back side of a circumferentially neighbouring blade. In addition or alternatively, the back side of the shank is constructed curvilinear. That is in particular, the back side comprises a convex shape. In case of the concavely shaped front side and the convexly shaped back side of the shank, a circle with a diameter C can be defined which is tangent to the front side and the back side of the shank. Said circle thereby preferably lies on a plane along the circumferential direction and perpendicular to the radial direction.

It is understood, that the dimensions of the recesses play an important role for achieving a required property of the blade, in particular regarding the limiting of resonance effects. Therefore a width B of the recess can be defined as the dimension along the radial direction and at the outer end of the recess, wherein the outer end of the recess is circumferentially furthest from the shank. Moreover a length A of the recess is defined as the axial dimension, i.e. the extension along the axial direction. For a recess having a deviation from a substantially axial direction, a corresponding definition of the length A can be given. The length A of the recess thereby and in particular depends on the shape and size of the downstream wall and upstream wall or the respective wall section, in case of a size variation and/or shape variation of the wall. Similarly, a depth D of the recess is defined as its dimension along the circumferential direction.

According to a further embodiment the depth D of the recess decreases or increases along the axial direction. That is the depth D varies along the axial direction, in particular in a linear manner. The depth D thus increases from the upstream side of the recess towards the downstream side of the recess or vice versa. This leads to a minimum depth and a maximum depth of the recess and a depth difference E as their difference.

In a further preferred embodiment at least one of the recesses fulfils all or at least one of the following ratios the length A of the recess is between 0 and (1.5×C), the width B of the recess is between 0 and (0.7×C), the depth difference E is between 0 and (0.45×C).

These ratio ranges are thereby enhancing the resonance damping property of the recesses, depending on the dimensions of the shank, in particular given by the diameter C of the circle arranged between the front side and the back side of the shank. They moreover reflect the dependency of the recess dimensions on the airfoil, wherein the airfoil preferably comprises a radial length between 100 mm and 772 mm. That is, the radial distance between the inner end of the airfoil and its outer end is preferably between 100 mm and 772 mm. This range of the radial length of the airfoil is however not mandatory for the desired properties achieved by the recess.

According to another embodiment the platform comprises at least one groove, preferably within the downstream wall and/or the upstream wall, in particular adapted for receiving at least one sealing plate, wherein the sealing plate in particular ensures a sealing between the blade and a neighbouring vane and/or a neighbouring blade. In contrast to the recesses, said groove preferably penetrates through the whole downstream wall or upstream wall along the circumferential direction. The groove is thereby preferably arranged above a recess within the same wall. That is for instance, if the upstream wall comprises a groove and a recess, the recess is arranged closer of the fixing part than the groove. The same holds for several grooves and/or several recesses wherein the recesses are preferably arranged below the groove/grooves with respect to the radial direction.

According to a preferred embodiment the downstream wall comprises a recess on the front side, i.e. the open side of the recess faces in the same direction as the front side of the shank. Moreover a groove is arranged above the recess with respect to the radial direction. Said recess preferably comprises a depth difference E due to an increasing depth from the downstream end of the recess towards its upstream end. The recess is further arranged on the downstream wall region adjacent to the fixing part of the platform, wherein the recess preferably extends into the fixing part.

According to a further preferred embodiment the blade comprises a shroud arranged at the outer end of the airfoil. The shroud comprises anyone form. Preferably the shroud extends over the whole axial range of the airfoil. That is the shroud substantially covers the whole airfoil in a top view along the axial direction. Said shroud in particular is used to improve a leakage of the driving gas of a respective turbine, by cooperating with a counterpart of the turbine. The shroud moreover preferably comprises a center of gravity radius or a center of rotation radius between 300 mm and 1594 mm. This dimension of the shroud in particular ensures an enhanced effect of the recess/recesses fulfilling the ratios given above.

In order to improve the leakage sealing of the shroud, the shroud comprises at least one fin according to a preferred embodiment, wherein the fin preferably runs along the circumferential direction and projects along the radial direction. That is, said fin projects away from the airfoil and runs along the radial direction. In case of several fins, these fins are preferably spaced apart in the axial direction.

A shroud includes anyone number fins. A shroud comprises at least one fin. A particularly preferred embodiment comprises a shroud comprising two fins, both projecting along the radial direction and away from the airfoil. Said fins moreover run along the circumferential direction in a parallel manner. They are further separated along the axial direction, wherein one fin is arranged on the upstream edge of the shroud while the other one is arranged on the downstream edge of the shroud.

According to a further embodiment, the fixing part of the blade comprises a fir tree form, which simplifies the assembly of the blade within a rotor. Of course the fixing part of the blade could comprise any other form.

According to a further advantageous embodiment of the invention, a rotor, in particular for a turbine, comprises at least one blade according to an embodiment of the invention. Said rotor is in particular characterised by improved mechanical properties, in particular by a decreased sensitivity to resonance effects. The rotor is thereby in particular adapted for rotation speeds between 0 revolutions per minute (rpm) and 3780 rpm, which lead to an enhanced suppression of said resonance effects. This limitation is however not necessary for the given advantageous properties of the rotor.

According to another beneficial embodiment a turbine, in particular a gas turbine, is equipped with a rotor according to an embodiment of the invention and/or a blade according to an embodiment of the invention, respectively.

It is understood that the aforementioned features and the features to be mentioned hereafter are applicable not only in the according combination, but also in other combinations as well as separated without departing from the scope of the invention.

The above and other features and advantages of the invention will become more apparent from the following description of certain preferred embodiments thereof, when taken in conjunction with the accompanying drawings.

Referring to FIG. 1 a blade 1 comprises an airfoil 2 and a platform 3 at the inner end of the airfoil 2 and a shroud 4 at the outer end of the airfoil 2. The term "inner" and "outer" are in relation to a radial direction, indicated by the arrow 5, of a shaft of a turbine in which the blade 1 is assembled. The shaft also defines an axial direction indicated by the arrow 6 and a circumferential direction indicated by the arrow 7. Moreover a direction of a driving fluid flowing through the turbine defines a flow direction, indicated by the arrow 8. The inner end of the airfoil 2 is thus closer to the shaft than the outer end of the airfoil 2. The shroud 4 comprises at least one fin 9. If there are more fins 9 (in the preferred embodiment according to FIG. 1 two fins 9 are shown) every fin 9 is similarly shaped and sized extending parallel in the circumferential direction, given by the arrow 7, and separated in the axial direction 6. One of the fins 9 thereby covers an upstream edge 10 of the shroud 4 completely, while the other fin 9 covers a downstream edge 11 of the shroud 4 completely, wherein the terms "upstream" and "downstream" are defined with respect to the flow direction of the driving gas given by the arrow 8.

Figure 2:
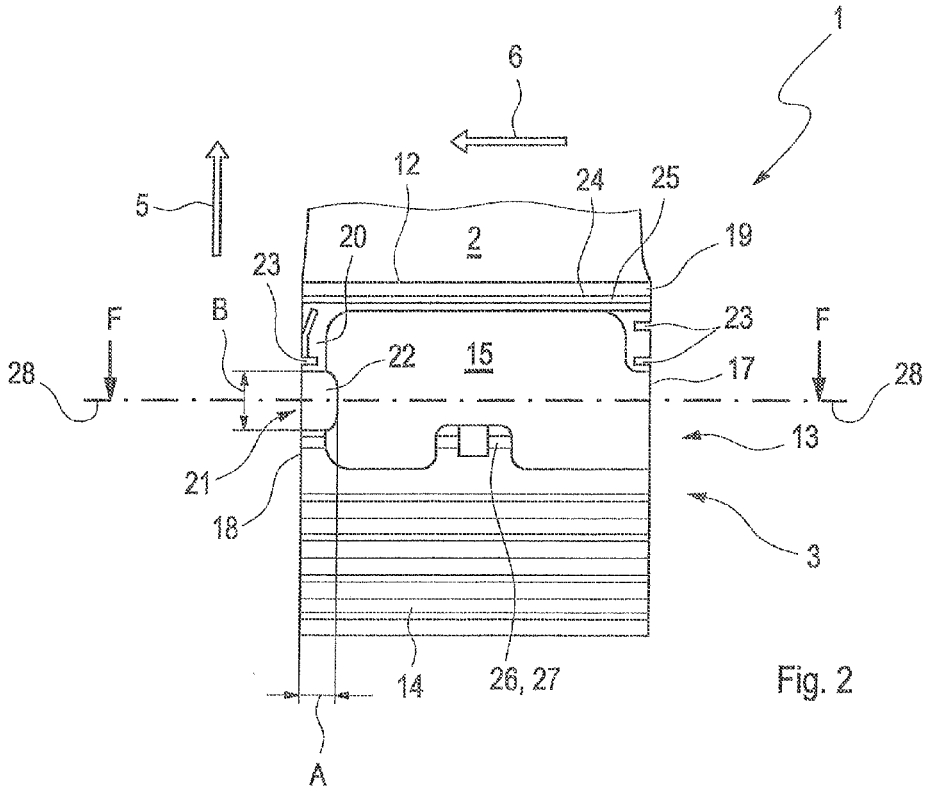
FIG. 2 shows a front view of the blade.

As seen in FIG. 1 and FIG. 2 the airfoil 2 is supported by a top plate 12 of the platform 3. A shank 13 of the platform 3 is arranged below the top plate 12 extending in the radial direction and a fixing part 14 comprising a fir tree form in the present embodiment is arranged adjacent and below the shank 13. The shank 13 comprises a front side 15 and a back side 16, wherein "front" and "back" are given with respect to the circumferential direction indicated by the arrow 7. Furthermore the shank 13 comprises an upstream side 17 and a downstream side 18, each given with respect to the flow direction of the driving fluid and thus with respect to the arrow 8. An upstream wall 19 extends radially from the top plate 12 towards the fixing part 14 on the upstream side 17 of the platform. The upstream wall 19 projects thereby beyond the front side 15 and the back side 16 of the shank 13 in the circumferential direction 7. That is, the upstream wall 19 projects away from the front side 15 on the front side 15 and away from the back side 16 on the back side 16. The upstream wall 19 moreover partially covers both the front side 15 and the back side 16 of the shank 13 on the upstream side 17 of the shank 13. A downstream wall 20 extends radially from the top plate 12 towards the fixing part 14 on both the front side 15 and the back side 16 of the shroud and covers the downstream side 18 of the shank 13 entirely. Thus the downstream wall 20 extends further than the upstream wall 19 along the radial direction. The upstream wall 19 and the downstream wall 20 each comprise a curved transition to the top plate 12. Moreover the top plate 12, the upstream wall 19 and the downstream wall 20 each comprise a curved transition to the front side 15 and the back side 16 of the shank 13.

A recess 21 extends through the downstream wall 20 in the axial direction given by the arrow 6 and on the front side 15 of the platform 3. An open side 22 of the recess 21 faces in the circumferential direction and thus faces in the same direction as the front side 15 of the shank 13. The lower side of the recess 21, i.e. the side nearer the fixing part 14, is thereby arranged at the very lower end of the downstream wall 20. Thus, the recess 21 is arranged adjacent to the fixing part 14. The upper side of the recess 21 runs parallel to the lower side of the upstream wall 19. That is, the upper side of the recess 21 and the lower side of the upstream wall 19 lie in a plane, wherein the plane in particular runs parallel to the axial direction. A groove 23 extending the full extent of the downstream wall 20 in the circumferential direction is arranged slightly above the upper end of the recess 21. Another similar groove 23 is arranged on the opposing side of the shank 13, i.e. the latter groove 23 extends through the upstream wall 19 and is arranged slightly above the lower end of the downstream wall 19. Another similar groove 23 is arranged above the latter groove 23. All grooves 23 are thus arranged in a parallel manner, whereby two of the grooves 23 are arranged in the upstream wall 19 and one groove 23 is arranged in the downstream wall 20. A slot 24 is arranged within the top plate 12, wherein said slot 24 extends along the front side of the top plate 12 in the axial direction. A sealing plate 25 is arranged within the slot 24 and projects away from the front side. Moreover, the recess 21 is bigger in shape and size than the grooves 23 and the slot 24.

All Figures show a receiving part 26 of the blade 1 arranged within the transition region of the shank 13 and the fixing part 14 and on the front side 15 of the shank 13. Said receiving part 26 is thereby arranged axially centerd within a protrusion 27 of the shank 13.

As drawn in FIG. 2, the dimensions of the recess 21 are defined as follows. The length A of the recess 21 is given as the difference in axial direction between an inner end and an outer end of the recess 21. The inner end thereby faces upstream while the outer end faces downstream. Furthermore a width B of the recess 21 is further defined as the radial dimension of the recess 21 and thus the dimension along the arrow 5. A depth D of the recess 21 is furthermore given by the dimension of the recess 21 in the circumferential direction.

Figure 3:
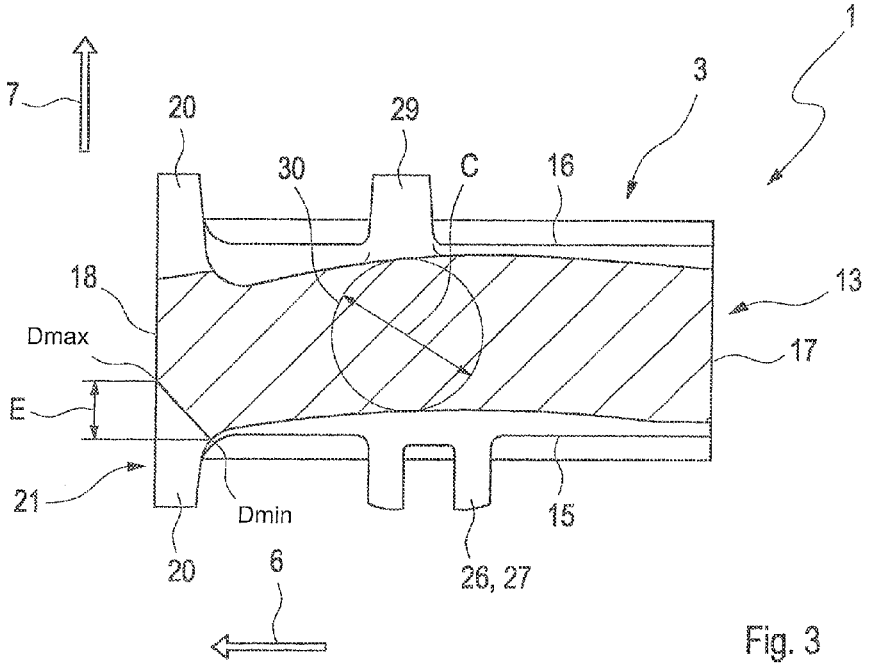
FIG. 3 shows a cross section of the blade.

FIG. 3 shows a cross section of the blade 1 through the plane 28 as viewed from a direction depicted by the arrows F, as illustrated in FIG. 2. This cross section reveals that the back side 16 of the shank 13 comprises a projection 29 arranged on the opposing side of the receiving part 26. The receiving part 26 and the projection 29 thus in particular serve to connect circumferentially neighbouring blades 1 of the rotor of the turbine. Furthermore, it can be seen that the front side 15 and the back side 16 both have a curved shape. Whereas the front side 15 is concave shaped, the back side 16 is convex shaped. The front side 15 thereby has an even curvature while the backside 16 has an increased degree of curvature at the interception region to the recess 21. A circle 30 contacting the curved front wall 15 and back wall 16 thus has a diameter C. FIG. 3 moreover reveals that the depth D of the recess 21 increases from the outer end of the recess 21 towards the inner end of the recess linearly. That is, the depth increases from the side of the recess 21 opposing the shank 13 towards the side of the recess 21 facing the shank 13. This leads to a difference of a maximum depth Dmax and a minimum depth Dmin given by a depth difference E.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

LIST OF REFERENCE NUMERALS

1 Blade
2 Airfoil
3 Platform
4 Shroud
5 Arrow depicting the radial direction
6 Arrow depicting the axial direction
7 Arrow depicting the circumferential direction
8 Arrow depicting the flow direction
9 Fin
10 Upstream edge
11 Downstream edge
12 Top plate
13 Shank
14 Fixing part
15 Front side
16 Back side
17 Upstream side
18 Downstream side
19 Upstream wall
20 Downstream wall
21 Recess
22 Open side of recess
23 Groove
24 Slot
25 Sealing plate
26 Receiving part
27 Protrusion
28 Plane
29 Projection
30 Circle
A Length of recess
B Width of recess
C Diameter of circle
D Depth of recess
Dmax Maximum depth D
Dmin Minimum depth D
E Depth difference of recess
F Arrows depicting the view direction

What is claimed is:

1. A blade for a rotor of a turbine comprising:

an airfoil;

a shroud disposed at an outer end of the airfoil; and a platform disposed at an inner end of the airfoil, the platform including a top plate disposed adjacent to the airfoil, a shank disposed below the top plate and a fixing part disposed below the shank, the shank and the fixing part each extending in a radial direction of the blade, the shank including a front side and a back side opposite the front side and facing in a circumferential direction of the blade, as well as a downstream side and an upstream side opposite the downstream side and facing in an axial direction of the blade;

an upstream wall projecting in the circumferential direction away from the shank and extending from the top plate toward the fixing part, the upstream wall at least partially covering the upstream side of the shank;

a downstream wall projecting in the circumferential direction away from the shank and extending from the top plate toward the fixing part, the downstream wall at least partially covering the downstream side of the shank;

at least one recess disposed in a region of the shank in at least one of the upstream wall and the downstream wall and at least partially penetrating the at least one of the upstream wall and the downstream wall in the axial direction, the at least one recess having an open side facing in a same direction as a respective one of the at least one of the upstream wall and the downstream wall, in which the at least one recess is disposed, is projecting;

wherein the front side of the shank has a concave shape and the back side of the shank has a convex shape such that a circle tangenting the concave-shaped front side and the convex-shaped back side has a diameter C, wherein the at least one of the recesses has a width B in the radial direction at a corresponding outer end and a length A along the axial direction, the length A corresponding to a thickness of a corresponding section of the at least one of the upstream wall and the downstream wall and wherein the at least one recess has a depth D in the circumferential direction that increases or decreases along the axial direction and a depth difference E corresponding to a difference between a maximum depth Dmax and a minimum depth Dmin such that at least one of:

the length A of the recess is less than (1.5×C);

the width B of the recess is less than (0.7×C); and the depth difference E is less than (0.45×C); and wherein the airfoil has a length in the radial direction of between 100 mm and 772 mm.

2. The blade according to claim 1, wherein the turbine is a gas turbine.

3. The blade according to claim 1, wherein the at least one of the upstream wall and the downstream wall includes at least one groove configured to receive at least one sealing plate.

4. The blade according to claim 3, wherein the at least one recess is disposed below the at least one groove along the radial direction.

5. The blade according to claim 3, wherein the at least one recess includes one recess disposed in the downstream wall and the at least one groove includes one groove disposed in the downstream wall, the one recess in the downstream wall being disposed below the one groove in the downstream wall along the radial direction.

6. The blade according to claim 1, wherein the shroud extends along substantially an entire extent of the airfoil in the axial direction.

7. The blade according to claim 1, wherein the shroud includes at least one fin extending in the circumferential direction and projecting in the radial direction.

8. The blade according to claim 7, wherein the at least one fin includes at least two fins spaced apart from one another in the axial direction.

9. The blade according to claim 1, wherein the shroud has a center of rotation radius of between 300 mm and 1594 mm.

10. The blade according to claim 1, wherein the fixing part has a fir tree form.

11. A rotor for a turbine configured to rotate between 0 revolutions per minute and 3780 revolutions per minute and having at least one blade comprising:

an airfoil;

a shroud disposed at an outer end of the airfoil; and a platform disposed at an inner end of the airfoil, the platform including a top plate disposed adjacent to the airfoil, a shank disposed below the top plate and a fixing part disposed below the shank, the shank and the fixing part each extending in a radial direction of the blade, the shank including a front side and a back side opposite the front side and facing in a circumferential direction of the blade, as well as a downstream side and an upstream side opposite the downstream side and facing in an axial direction of the blade;

an upstream wall projecting in the circumferential direction away from the shank and extending from the top plate toward the fixing part, the upstream wall at least partially covering the upstream side of the shank;

a downstream wall projecting in the circumferential direction away from the shank and extending from the top plate toward the fixing part, the downstream wall at least partially covering the downstream side of the shank; and at least one recess disposed in a region of the shank in at least one of the upstream wall and the downstream wall and at least partially penetrating the at least one of the upstream wall and the downstream wall in the axial direction, the at least one recess having an open side facing in a same direction as a respective one of the at least one of the upstream wall and the downstream wall, in which the at least one recess is disposed, is projecting; and wherein the front side of the shank has a concave shape and the back side of the shank has a convex shape such that a circle tangenting the concave-shaped front side and the convex-shaped back side has a diameter C, wherein the at least one of the recesses has a width B in the radial direction at a corresponding outer end and a length A along the axial direction, the length A corresponding to a thickness of a corresponding section of the at least one of the upstream wall and the downstream wall and wherein the at least one recess has a depth D in the circumferential direction that increases or decreases along the axial direction and a depth difference E corresponding to a difference between a maximum depth Dmax and a minimum depth Dmin such that at least one of:

the length A of the recess is less than (1.5×C);

the width B of the recess is less than (0.7×C); and the depth difference E is less than (0.45×C); and wherein the airfoil has a length in the radial direction of between 100 mm and 772 mm.

12. The rotor according to claim 11 wherein the turbine is a gas turbine.

13. A turbine having a rotor and at least one blade comprising:

an airfoil;

a shroud disposed at an outer end of the airfoil; and a platform disposed at an inner end of the airfoil, the platform including a top plate disposed adjacent to the airfoil, a shank disposed below the top plate and a fixing part disposed below the shank, the shank and the fixing part each extending in a radial direction of the blade, the shank including a front side and a back side opposite the front side and facing in a circumferential direction of the blade, as well as a downstream side and an upstream side opposite the downstream side and facing in an axial direction of the blade;

an upstream wall projecting in the circumferential direction away from the shank and extending from the top plate toward the fixing part, the upstream wall at least partially covering the upstream side of the shank;

a downstream wall projecting in the circumferential direction away from the shank and extending from the top plate toward the fixing part, the downstream wall at least partially covering the downstream side of the shank; and at least one recess disposed in a region of the shank in at least one of the upstream wall and the downstream wall and at least partially penetrating the at least one of the upstream wall and the downstream wall in the axial direction, the at least one recess having an open side facing in a same direction as a respective one of the at least one of the upstream wall and the downstream wall, in which the at least one recess is disposed, is projecting; and wherein the front side of the shank has a concave shape and the back side of the shank has a convex shape such that a circle tangenting the concave-shaped front side and the convex-shaped back side has a diameter C, wherein the at least one of the recesses has a width B in the radial direction at a corresponding outer end and a length A along the axial direction, the length A corresponding to a thickness of a corresponding section of the at least one of the upstream wall and the downstream wall and wherein the at least one recess has a depth D in the circumferential direction that increases or decreases along the axial direction and a depth difference E corresponding to a difference between a maximum depth Dmax and a minimum depth Dmin such that at least one of:

the length A of the recess is less than (1.5×C);

the width B of the recess is less than (0.7×C); and the depth difference E is less than (0.45×C); and wherein the airfoil has a length in the radial direction of between 100 mm and 772 mm.

14. The turbine according to claim 13, wherein the turbine is a gas turbine.

* * * * *